United States Patent [19]

Nakamura

[11] Patent Number: 4,557,115

[45] Date of Patent: Dec. 10, 1985

[54] HEAT PUMP HAVING IMPROVED COMPRESSOR LUBRICATION

[75] Inventor: Takashi Nakamura, Wakayama, Japan

[73] Assignee: Mitsubishi Denki Kabushiki Kaisha, Tokyo, Japan

[21] Appl. No.: 610,728

[22] Filed: May 16, 1984

[30] Foreign Application Priority Data

| | | | |
|---|---|---|---|
| May 25, 1983 | [JP] | Japan | 58-93635 |
| May 25, 1983 | [JP] | Japan | 58-93636 |
| May 25, 1983 | [JP] | Japan | 58-93637 |
| May 25, 1983 | [JP] | Japan | 58-93638 |

[51] Int. Cl.[4] ..... F25B 31/00; F25B 43/00

[52] U.S. Cl. ..... 62/156; 62/193; 62/473; 62/503

[58] Field of Search ..... 62/193, 470, 471, 473, 62/84, 503, 156

[56] References Cited

U.S. PATENT DOCUMENTS 2,665,557 1/1954 Dodson ..... 62/193

*Primary Examiner*—William E. Wayner

*Attorney, Agent, or Firm*—Sughrue, Mion, Zinn, Macpeak, and Seas

[57] ABSTRACT

A heat pump having improved compressor lubrication wherein an adequate amount of refrigerator oil is returned to the compressor at all times and the circulation time for the refrigerator oil is reduced. An oil separator is connected between a discharge side of the compressor and a four-way valve of the heat pump system. A bypass is connected between the oil separator and the accumulator. The bypass is provided with an electromagnetic valve for selectively opening and closing the bypass. A control device periodically opens the electromagnetic valve during the operation of the compressor to provide for supply of refrigerator oil to the compressor from the oil separator.

7 Claims, 3 Drawing Figures

HEAT PUMP HAVING IMPROVED COMPRESSOR LUBRICATION

BACKGROUND OF THE INVENTION

The present invention relates to a heat pump system having an indoor unit and an outdoor unit.

A conventional heat pump of this type is as shown in FIG. 1.

In FIG. 1, reference numeral 1 designates a compressor; 2, a four-way valve; 3, an outdoor heat exchanger; 4, a distributor; 5, an expansion valve; 6, a connecting pipe; 7, an indoor heat exchanger; 8, a connecting pipe; and 9, an accumulator. At least the indoor heat exchanger 7 is included in the indoor unit, and the members which are not included in the indoor unit are included in the outdoor unit.

The cooling cycle is as follows: A high-temperature, high-pressure refrigerant discharged from the compressor 1 during the room cooling operation and a lubricating refrigerator oil mixed with the refrigerant flow through the four-way valve 2 to the outdoor heat exchanger 3 where they are changed into a high-temperature, high-pressure liquid refrigerant by heat-exchange. The liquid refrigerant is delivered via the distributor 4 through the expansion valve 5 where its pressure is decreased. The liquid refrigerant thus treated is sent through the pipe 6 to the indoor heat exchanger 7 where it is evaporated. The vapor thus formed flows through the pipe 8, the four-way valve 2 and the accumulator 9 to the compressor 1.

This conventional heat pump suffers from a drawback in the case where the connecting pipes 6 and 8 are long. Specifically, during the continuous operation of the compressor 1, the refrigerator oil mixed with the refrigerant discharged from the compressor 1 is also discharged continuously, and it takes a relatively long time until the refrigerator oil thus discharged returns to the compressor 1. Accordingly, the amount of refrigerator oil in the compressor 1 tends to decrease, as a result of which the compressor is not sufficiently lubricated and the sliding parts may seize. This difficulty may arise also in the room heating mode. Moreover, when the system is operating in a capacity control mode or low load mode, the amount of circulation of the refrigerant is reduced, as is the velocity of the refrigerant flowing in the pipe, as a result of which the amount of refrigerator oil returned to the compressor is decreased. Thus, as in the above-described case, lubrication of the compressor becomes insufficient.

SUMMARY OF THE INVENTION

An object of the invention is thus to eliminate the above-described difficulties accompanying the conventional heat pump.

In accordance with this and other objects, the invention provides a heat pump in which an oil separator is connected between the discharge side of a compressor and a four-way valve, and the oil separator is connected to an accumulator through a bypass path including an electromagnetic valve. The electromagnetic valve is opened by a control device for a predetermined period of time at predetermined time intervals during the operation of the compressor so that the refrigerator oil collected in the oil separator is returned through the bypass path to the accumulator, thereby preventing unsatisfactory lubrication of the compressor due to an insufficient supply of refrigerator oil.

DESCRIPTION OF THE PREFERRED EMBODIMENTS

A preferred embodiment of a heat pump of the invention will be described with reference to FIGS. 2 and 3.

Figure 1:
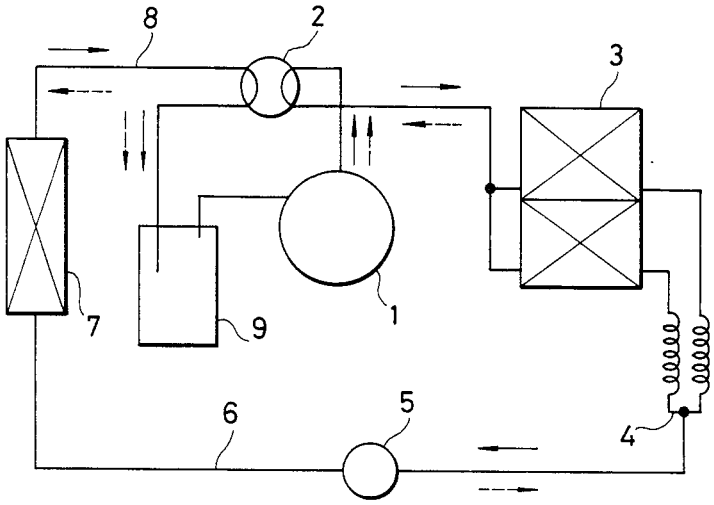
FIG. 1 is an explanatory diagram showing a conventional heat pump system.
Figure 2:
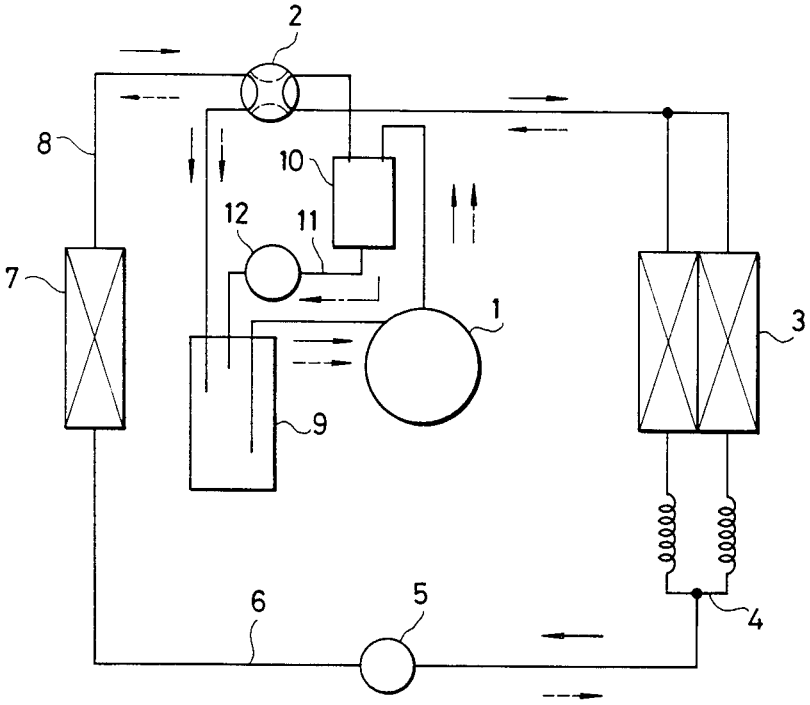
FIG. 2 is an explanatory diagram showing a heat pump system of the invention.

In FIG. 2, those components which have been described with reference to FIG. 1 are similarly identified. In FIG. 2, reference numeral 10 designates an oil separator whose upper part is connected between the discharge side of the compressor 1 and the four-way valve 2; 11, a bypass path connected between the lower part of the oil separator 10 and the accumulator 9; and 12, an electromagnetic valve provided in the bypass path 11.

Figure 3:
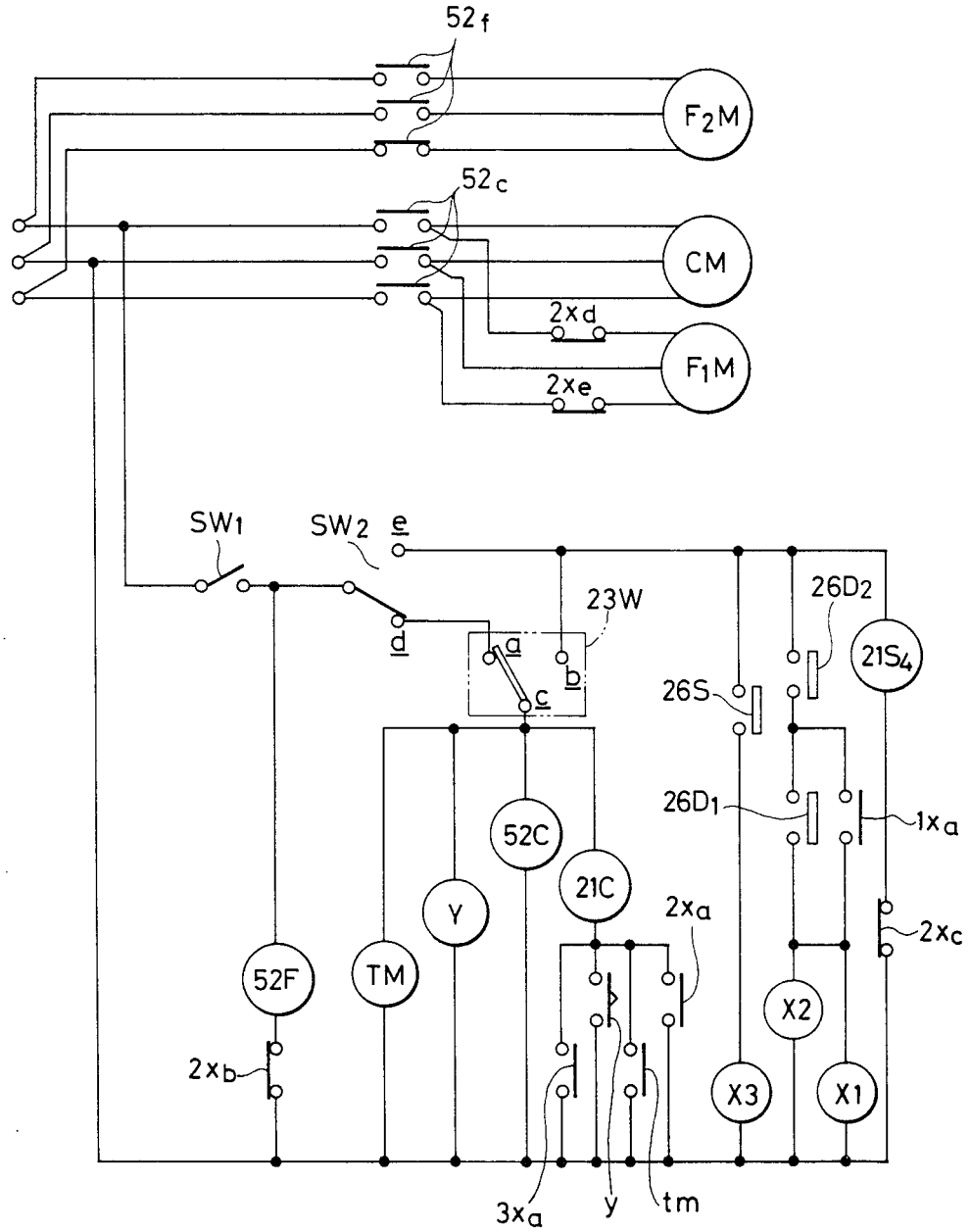
FIG. 3 is a circuit diagram showing a control device used in the heat pump of FIG. 2.

FIG. 3 shows the electrical circuit of a control device used with the heat pump of FIG. 2. In FIG. 3, CM designates an electric motor for driving the compressor 1; $F_1M$, an electric motor for driving an air blower for forcing air through the outdoor heat-exchanger 3; $F_2M$, an electric motor for driving an air blower for forcing air through the indoor heat exchanger 7; $SW_1$, an operating switch; $SW_2$, a cooling/heating changeover switch; and 23W, a room temperature thermostat. When the room temperature is higher than a predetermined value, the armature of the switch 23W is tripped over to a contact a, and when it is lower than the predetermined value, the armature is tripped over to a contact b.

Further in FIG. 3, 52F designates the coil of a contactor of the air blower motor $F_2M$. When the coil 52F is energized, its contacts 52f are closed to supply current to the motor $F_2M$ to run the latter. When the coil 52F is deenergized, the contacts 52f are opened to stop the motor $F_2M$. 52C designates the coil of a contactor for the compressor motor CM and the air blower motor $F_1M$. When the coil 52C is energized, its contacts **52*c* are closed to operate the compressor motor CM and the air blower motor $F_1M$. When the coil 52C is deenergized, the contacts 52*c* are opened to stop the motors CM and $F_1M$. The electromagnetic valve 12 is provided with a coil 21C. When the coil 21C is energized, the electromagnetic valve 12 is opened, and when it is deenergized, the valve 12 is closed. A coil 21S is provided for the four-way valve 2. When the coil $21S_4$ is energized, a room heating operation in which refrigerant flows as indicated by the broken-line arrows in FIGS. 2 is carried out. When it is deenergized, a room cooling operation (or defrosting operation) in which refrigerant flows as indicated by the solid-line arrows in FIG. 2** is carried out.

Further in FIG. 3, TM designates an electric motor for a timer. The time motor TM is rotated when energized, and it is stopped when deenergized. The timer has a contact tm. The timer motor TM makes one revolution in a set period ($tm_1+tm_2$). The contact tm is opened for the period $tm_1$ and closed for the period $tm_2$. This operation is repeatedly carried out. Reference character Y designates a time limit relay. When the time limit relay Y is energized, its contact y is closed for a predetermined period $tm_3$, and thereafter it is maintained opened as long as the relay is energized. The contactor's coil 52C, the coil 21C of the electromagnetic valve 12, the timer motor TM, and the time limit relay Y are connected to the contact c of the room temperature thermostat 23W in such a manner that they are connected in parallel with one another.

Further in FIG. 3, 26S designates the contact of a thermostat installed on the intake pipe. The contact 26S is closed when the temperature is at a predetermined value or lower, and it is opened when the temperature is higher than that value. $26D_1$ designates the contact of a defrosting starting thermostat. The contact $26D_1$ is closed when the temperature is at predetermined value or lower, and it is opened when the temperature is higher than that value. The numeral $26D_2$ designates the contact of a defrosting ending thermostat. The contact $26D_2$ is closed when the temperature is at a predetermined value or lower, and it is opened when the temperature is higher than that value. The predetermined value for the defrosting starting thermostat is of course lower than that for the defrosting ending thermostat.

In FIG. 3, reference character X2 designates the coil of an auxiliary relay. The coil X2 is connected in series with the thermostat contacts $26D_1$ and $26D_2$. When the coil X2 is energized, its contact *2xa* is closed while its contacts *2xb*, *2xc*, *2xd* and *2xe* are opened. When the coil X2 is deenergized, the contact *2xa* is opened, while the contacts *2xb*, *2xc*, *2xd* and *2xe* are closed. X3 designates the coil of an auxiliary relay. The coil X3 is connected in series with the contact 26S of the thermostat. When the coil X3 is energized, its contact *3xa* is opened. X1 designates the coil of an auxiliary relay. The coil X1 is connected in series with the thermostat contacts $26D_1$ and $26D_2$ and in parallel with the auxiliary relay coil X2. When the coil X2 is energized, its contact *1xa* is closed, and when it is deenergized, the contact *1xa* is opened. The contact tm of the timer, the contact y of the time limit relay Y and the contacts *2xa* and *3xa* of the auxiliary relay coils X2 and X3 are connected in parallel with the coil 21C of the electromagnetic valve 12.

When the operating switch $SW_1$ is turned on in the room cooling mode and the room temperature is higher than the predetermined value of the thermoswitch 23W, the coil 52F of the contactor is energized to close the contacts 52f so that the air blower motor of the indoor heat exchanger is started and the armature of the cooling/heating changeover switch is set to the cooling contact d. As the armature of the thermostat 23W is positioned at the contact a, the coil 52C is energized to close the contacts **52*c*. As a result, the compressor motor CM is driven to start the compressor 1**.

The time limit relay Y is also excited, and the contact y is closed. As a result, the coil 21C of the electromagnetic valve is excited to open the latter and the bypass path is opened. In the predetermined period $tm_3$, the time limit relay Y is deenergized and the contact y is opened. As a result, the coil 21C of the electromagnetic valve 12 is deenergized to close the latter, and the bypass path 11 is closed. The same procedure is followed for the starting operation in the room heating mode. The timer motor TM is rotated continuously. When the set period $tm_1$ has passed, the contact tm is closed, and the coil 21C of the electromagnetic valve 12 is energized to open the latter. When the set period $tm_2$ has passed, the contact tm is opened. As a result, the coil 21C is deenergized to close the electromagnetic valve 12. The above-described operations are repeatedly carried out, as is also the case for the room heating mode.

When in the room heating mode the room temperature is lower than the predetermined value of the thermostat 23W, the operating switch $SW_1$ is turned on, the coil 52F is energized to close its contact 52f, and hence the air blower motor $F_2M$ of the indoor heat exchanger is started and the armature of the cooling/heating changeover switch $SW_2$ is set to the heating contact e. As a result, the coil $21S_4$ of the four-way valve 2 is energized, thus effecting a room heating operation. As the armature of the thermostat 23W is positioned at the contact b, the contactor's coil 52C is energized to close its contacts **52*c*, thus starting the compressor 1**.

On the other hand, the time limit relay Y is also energized, and the contact y is closed. As a result, the coil 21C of the electromagnetic valve 12 is energized to open the latter, and the bypass path 11 is formed. In the predetermined period $tm_3$, the relay Y is deenergized to open the contact y. As a result, the coil 21C is deenergized to close the electromagnetic valve 12, and the bypass path 11 is closed.

The timer motor TM is rotated continuously, being supplied with current. As in the room cooling mode described above, the coil 21C is energized in the predetermined period $tm_1$ and is deenergized in the predetermined period $tm_2$. Thus, the electromagnetic valve 12 is repeatedly opened and closed.

When in the room heating mode the temperature is low and the temperature sensed by the thermostat installed on the intake pipe becomes lower than the predetermined value, its contact 26S is closed so that the auxiliary relay coil X3 is energized to close the contact *3xa*. As a result, the coil 21C of the electromagnetic valve is energized to open the electromagnetic valve 12, and hence the bypass path 11 is opened.

The defrosting operation is carried out as follows: When the temperature reaches the set value of the defrosting ending thermostat, the contact $26D_2$ is closed. When the temperature reaches the set value of the defrosting starting thermostat, its contact $26D_1$ is closed. Therefore, the auxiliary relay coil X2 is energized and the contact *2xc* is opened. As a result, the coil $21S_4$ of the four-way valve 2 is deenergized so that the defrosting operation is started. At the same time, the contacts *2xd* and *2xe* of the auxiliary relay coil X2 are opened to stop the motor $F_1M$ of the indoor heat exchanger 7, while the contact *2xa* is opened to energize the coil 21C of the electromagnetic valve 12 to open the latter and open the bypass path 11. The auxiliary relay coil X1 is energized to close the contact *1xa*, and the contact *1xa* is connected in parallel with the contact $26D_1$ of the defrosting operation, the temperature becomes higher than the set value of the defrosting starting thermostat and the contact $26D_1$ is opened. Thus, a circuit composed of the contact $26D_2$ of the defrosting ending thermostat, the contact *1xa*, and the auxiliary relay coils X2 and X1 is formed. When the temperature becomes higher than the set value of the defrosting ending thermostat, the contact $26D_2$ is opened. As a result, the auxiliary relay coils X2 and X1 are deenergized. Thus, the defrosting operation is ended.

The operation of the heat pump shown in FIG. 2 will be described. In FIG. 2, the flow of refrigerant in the room cooling mode and in the defrosting mode is as indicated by the solid line arrows, the flow of refrigerant in the room heating operation is as indicated by the broken line arrows, and the flow of refrigerant and refrigerator oil in the bypass path is as indicated by the one-dot chain line arrow.

In the room cooling operation, the high-temperature, high-pressure refrigerant gas and refrigerator oil discharged from the compressor 1 flow into the oil separator 10 where the refrigerator oil is separated from the refrigerant gas. The refrigerator oil thus separated is pooled in the bottom of the oil separator 10. The refrigerant gas separated from the refrigerator oil flows out through the upper part of the oil separator 10 and through the four-way valve 2 to the outdoor heat exchanger 3 where it is changed into a high-temperature, high pressure liquid refrigerant by heat exchange. The liquid refrigerant is delivered through the distributor 4 to the expansion valve 5 where its pressure is decreased. The liquid refrigerant thus treated is passed through the connecting pipe 6 to the indoor heat-exchanger 7 where it is evaporated. The vapor thus formed is returned to the compressor through the connecting pipe 8, the four-way valve 2 and the accumulator 9.

In this operation, the electromagnetic valve 12 in the bypass path 11 is maintained closed. However, when the refrigerator oil is collected in the oil separator 10, the electromagnetic valve 12 is opened. As a result, the refrigerator oil collected in the lower part of the oil separator is returned through the bypass path 11 and the electromagnetic valve 12 to the accumulator 9, and then returned to the compressor 1 together with the low-temperature, low-pressure refrigerant gas returned from the indoor heat-exchanger 7.

As is apparent from the above description, the refrigerator oil circulation circuit is reduced in length compared with that of the conventional air conditioner. Substantially the same operation is carried out for the room heating operation.

Accordingly, even in the case where the distance between the indoor heat-exchanger and the outdoor heat-exchanger of the air conditioner is long, that is, where the connecting pipes 6 and 8 are long, the refrigerator oil circulation circuit is short, passing through the bypass path 11, and therefore a sufficient amount of refrigerator oil is supplied to the compressor 1 at all times. In addition, even when the circulation of refrigerant discharged from the compressor 1 is greatly reduced, such as when the compressor 1 is operated in the capacity control mode, so that the velocity of the refrigerant in the piping is decreased, a sufficient amount of refrigerator oil is still returned because the length of the refrigerator oil circulation circuit is short.

In starting the compressor 1, the electromagnetic valve 12 is maintained opened by the time limit relay Y for the predetermined period $tm_3$ after starting. Therefore, even in the case that the refrigerant mixed in the refrigerator oil when the compressor 1 is stopped is foamed by the starting of the compressor so that a large amount of refrigerator oil is discharged from the compressor 1 compared with the amount of refrigerator oil discharged in ordinary continuous operations, the refrigerator oil, separated from the refrigerant by the oil separator, flows through the bypass path 11 without passing through the refrigerant circuit. The refrigerator oil is returned through the opened electromagnetic valve 12 to the accumulator 9 and is then returned to the compressor 1 together with the low-pressure gas, thus complementing the refrigerator oil in the compressor 1.

When the room heating operation is switched over to the defrosting operation, the auxiliary relay coil X2 is excited to close contact **2*xa* so that the electromagnetic valve coil 21C is energized to open the electromagnetic valve 12 while the four-way valve 2 is switched. Therefore, the high-temperature, high-pressure refrigerant gas compressed by the compressor 1 flows through the oil separator 10 and the four-way valve 2 to the outdoor heat-exchanger 3 to defrost the latter. Then, the refrigerant gas is delivered through the distributor 4 to the expansion valve 5 where its pressure is decreased. The gas thus treated is returned through the connecting pipe 6, the indoor heat-exchanger 7, the connecting pipe 8 and the four-way valve 2 to the accumulator 9. At the same time, a part of the high-temperature, high-pressure refrigerant gas discharged from the compressor 1 is returned through the oil separator 10, the bypass path 11 and the electromagnetic valve 12 to the accumulator 9. In the accumulator 9, the high-temperature, high-pressure refrigerant gas flowing through the bypass path 11 is mixed with the low-temperature, low-pressure refrigerant gas passing through the indoor heat-exchanger serving as an evaporator. Therefore, the low-pressure refrigerant gas is returned to the compressor 1** after its pressure has been increased. Accordingly, the specific volume of the refrigerant gas can be increased while the circulation thereof is increased. Therefore, frost on the outdoor heat-exchanger can be melted and removed in a short period.

When in the room heating operation the temperature is low, the outdoor heat-exchanger 3 tends to frost rapidly. Therefore, when the temperature becomes lower than the set value of the thermostat installed on the intake pipe, the contact 26S is closed so that the auxiliary relay coil X3 is excited to close its contact **3*xa*. As a result, the contact 21C of the electromagnetic valve 12 is energized to open the latter so that a part of the high-temperature, high-pressure refrigerant gas from the compressor 1 is returned through the oil separator 10 and the bypass path 11 to the accumulator 9**. Thus, the heating capacity in the room heating operation with the temperature being low is improved.

In the case where the compressor 1 used is a variable capacity type, the defrosting capacity and the room heating capacity can be effectively increased by setting the maximum operating capacity of the compressor in consideration of the case where the electromagnetic valve 12 is open in the defrosting operating or in the room heating operation with the temperature being low.

In either the room cooling operation or in the room heating operation, a continuous operation is carried out for the predetermined period $tm_1$ after the start of the compressor 1, and thereafter the contact tm of the timer motor TM is closed to cause the timer motor TM to continue rotating. Therefore, the coil 21C is energized for the set period $tm_3$ at time intervals $tm_2$ to open the electromagnetic valve 12. Accordingly, the refrigerator oil collected in the oil separator 10 is returned from the oil separator 10 through the bypass path 11 and the electromagnetic valve 12 to the accumulator 9 and is then returned to the compressor 1 together with the low-temperature, low-pressure refrigerant gas returned from the heat-exchanger operating as an evaporator. Thus, refrigerator oil is sufficiently supplied to the compressor at all times.

In the described embodiment, even if the refrigerant in the connecting pipe 8 is returned to the discharge side of the compressor 1 by gravity while the heat pump is not in operation, it is collected by the oil separator 10 so that it does not enter the outlet of the compressor 1. Thus, the valves of the compressor 1 are protected from damage at the start.

The invention has been described with reference to a heat pump where the compressor is provided outdoors; however, it should be noted that the technical concept of the invention is applicable to a remote-type installation in which the compressor is provided indoors. Furthermore, in the above-described embodiment, the expansion valve 5 is used as a throttling device. However, a throttling device such as a capillary tube, electrical expansion valve or orifice may be employed, and it may be installed at any position between the indoor heat-exchanger 7 and the outdoor heat-exchanger 3.

As described above, according to the invention, an oil separator is connected between the discharge side of the compressor and the four-way valve, and the oil separator is connected to the accumulator through the bypass path including the electromagnetic valve. Therefore, when the electromagnetic valve is opened, the refrigerator oil and the high-temperature, high-pressure refrigerant gas are returned through the bypass path to the accumulator. Accordingly, the distance between the indoor unit and the outdoor unit, namely, the length of the pipe between these units, can be increased with ease. Furthermore, even in the case where the amount of the refrigerant discharged is greatly decreased by the use of a variable capacity type compressor, a sufficient amount of refrigerator oil is always supplied to the compressor. As the control device includes a device such as a timer for opening the electromagnetic valve for predetermined periods at predetermined times during the operation of the compressor, the refrigerator oil which is continuously discharged from the compressor while being mixed with the refrigerant gas can be returned through the bypass path and the accumulator to the compressor. Thus, the reliability of the heat pump system has been remarkably improved.

I claim:

1. In a heat pump comprising an accumulator, a serially connected compressor, a four-way valve, an outdoor heat-exchanger, a throttling device, an indoor heat-exchanger, a refrigerant and an oil, the improvement wherein said heat pump further comprises:

an oil separator connected between a discharge side of said compressor and said four-way valve for separating said oil from said refrigerant;

a bypass connected between said oil separator and said accumulator for transferring said separated oil to said accumulator in which said transferred oil is combined with said refrigerant, said bypass comprising an electromagnetic valve; and a control device comprising means for periodically opening said electromagnetic valve during operating periods of said compressor.

2. The heat pump of claim 1, wherein said oil separator comprises a container having an upper end connected to said discharge side of said compressor and said four-way valve and a lower side connected to said bypass.

3. The heat pump of claim 2, wherein said control device comprises a timer and a room temperature thermostat, said timer being operated in response to said room temperature thermostat, and a coil of said control device being operated by said timer.

4. The heat pump of claim 3, wherein said timer comprises a motor connected in series with said room temperature thermostat and a contact connected in series with said coil of said electromagnetic valve.

5. The heat pump of claim 4, wherein said control device further comprises a time limit relay having a coil connected in series with said motor of said timer, said time limit relay having a contact connected in parallel with said contact of said timer.

6. The heat pump of claim 5, wherein said control device further comprises a thermostat thermally coupled to a intake pipe and a first auxiliary relay having a coil connected in series with said thermostat thermally coupled to said intake pipe, said first auxiliary relay having a contact connected in parallel with said contact of said timer.

7. The heat pump of claim 6, wherein said control device further comprises a defrosting starting thermostat and a defrosting ending thermostat connecting in series with one another, and a second auxiliary relay connected in series with said defrosting starting thermostat and said defrosting ending thermostat, said second auxiliary relay having a contact connected in parallel with said contact of said timer.

* * * * *